United States Patent [19]

Frentzel et al.

[11] Patent Number: 4,595,458

[45] Date of Patent: Jun. 17, 1986

[54] PROCESS FOR USING SELECTED FATTY ACID ADDUCTS OF A 1,2,4-TRIAZOLE AS SIZING OR WATERPROOFING AGENTS FOR CELLULOSIC MATERIALS

[75] Inventors: Richard L. Frentzel, Guilford; Michael L. Rosin, Madison, both of Conn.

[73] Assignee: Olin Corporation, Cheshire, Conn.

[21] Appl. No.: 734,990

[22] Filed: May 17, 1985

[51] Int. Cl.[4] ..... D21H 3/12

[52] U.S. Cl. ..... 162/158; 8/189; 8/194; 162/135; 162/179; 427/394; 427/395

[58] Field of Search ..... 162/158, 179, 135; 8/189, 194; 427/394, 395

[56] References Cited

U.S. PATENT DOCUMENTS

| | | | |
|---|---|---|---|
| 2,639,990 | 5/1953 | Kendall et al. | 162/158 |
| 3,993,640 | 11/1976 | Pickard et al. | 536/30 |
| 4,066,493 | 1/1978 | Pickard | 8/189 |
| 4,222,820 | 9/1980 | Hiskens et al. | 162/158 |

FOREIGN PATENT DOCUMENTS

| | | | |
|---|---|---|---|
| 43-7907 | 3/1968 | Japan | 8/194 |
| 1384405 | 2/1972 | United Kingdom . | |

OTHER PUBLICATIONS

James P. Casey, Pulp and Paper—Chemistry and Chemical Technology, Third Edition, vol. 3, John Wiley and Sons, NY, pp. 1577–1584 and 1705–1709.

*Primary Examiner*—Peter Chin

*Attorney, Agent, or Firm*—William A. Simons; Thomas P. O'Day

[57] ABSTRACT

Disclosed is a process for treating a cellulosic material selected from the group consisting of cellulose, regenerated cellulose, and mixtures thereof, comprising the steps of:

contacting the cellulosic material with a dispersion comprising an effective sizing or waterproofing amount of a fatty acid adduct of a 1,2,4-triazole having the formula:

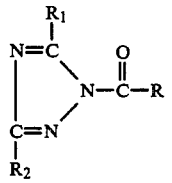

wherein R is an alkyl or alkenyl group having about 11 to about 21 carbon atoms and wherein $R_1$ and $R_2$ are individually selected from hydrogen or a lower alkyl group having 1 to 4 carbon atoms.

15 Claims, No Drawings

PROCESS FOR USING SELECTED FATTY ACID ADDUCTS OF A 1,2,4-TRIAZOLE AS SIZING OR WATERPROOFING AGENTS FOR CELLULOSIC MATERIALS

BACKGROUND OF THE INVENTION

1. Field of the Invention

The present invention relates to the treatment of cellulosic materials, more specifically to sizing paper and to waterproofing textiles, with selected fatty acid adducts of a 1,2,4-triazole.

2. Description of the Prior Art

In the pulp and paper industry and in the textile industry, the finished cellulosic material's resistance toward the pentration of liquids such as water, inks and oils is improved by the addition of sizing or waterproofing agents. These agents generally consist of a hydrophobic moiety in combination with a cellulosic reactive group which reacts with the hydroxyl group in cellulose. This reaction normally leaves the hydrophobic moiety attached to the cellulosic material and, thus, it will resist the penetration of liquids onto the cellulosic molecule.

Commonly used synthetic sizing and waterproofing agents include ketene dimers, alkenyl succinic anhydrides and stearic anhydride. While these sizing agents are generally effective, they do not work well under all use conditions. The employment of certain pH values or certain emulsification or curing conditions may present processing obstacles. Furthermore, workers in this art are looking for still lower cost sizing and waterproofing agents.

An object of the prevent invention is to provide a new class of effective sizing and waterproofing agents for cellulosic materials.

BRIEF SUMMARY OF THE INVENTION

The present invention, therefore, is directed to a process for treating a cellulosic material selected from the group consisting of cellulose, regenerated cellulose, and mixtures thereof, comprising the steps of:

contacting the cellulosic material with a dispersion comprising an effective sizing or waterproofing amount of a fatty acid adduct of a 1,2,4-triazole having the formula (I):

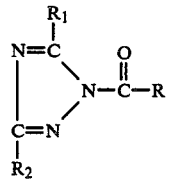

(I)

wherein R is an alkyl or alkenyl group having about 11 to about 21 carbon atoms and wherein $R_1$ and $R_2$ are individually selected from the group consisting of hydrogen or a lower alkyl group having 1 to 4 carbon atoms.

Another embodiment of the present invention is directed to the cellulosic materials treated with the above-noted fatty acid adducts of a 1,2,4-triazole of formula (I) and thereby having improved penetration resistance to liquids.

DETAILED DESCRIPTION

These fatty acid adducts of a 1,2,4-triazole of formula (I) above may be prepared by reacting a fatty acid chloride with a 1-hydrogen-1,2,4-triazole, preferably in the presence of triethylamine or excess 1,2,4-triazole as an acid scavenger and by preferably using a suitable solvent (e.g. 1,2-dichloroethane) or both. It should be recognized that the present invention is not dependent upon any particular method for making these fatty acid adducts and any and all suitable synthesis methods may be used for making the compounds employed in this invention.

The preferred fatty acid adduct is 1-stearoyl-1,2,4-triazole. Unsubstituted ($R_1=R_2=$hydrogen) 1,2,4-triazole adducts like this one are favored over their lower alkyl-substituted analogs ($R_1$ or $R_2$ or both=a lower alkyl group) because they have a higher weight proportion of a hydrophobic moiety, which means that more of the molecule (i.e. the hydrophobe) will be attached to the cellulosic material when reacted thereto. Therefore, there is more effect on a weight basis. Stearic acid [$R=-(CH_2)_{16}CH_3$] is a preferred fatty acid because it forms an adduct which has been found to be particularly useful as a paper sizing agent. This adduct is believed to be particularly suitable as either an internal or external (surface) paper sizing agent because of a combination of properties possessed by it. First, it reacts relatively fast with cellulosic material such as paper or pulp. Second, it has sufficient hydrolytic stability so that it does not degrade in an aqueous emulsion system before reacting with the cellulosic material. Third, when reacted with cellulosic material it leaves a suitable hydrophobic portion of itself attached to the cellulosic material to provide effective sizing or waterproofing properties to that material. R as defined above is believed to cover other suitable hydrophobic moieties that provide adequate sizing and waterproofing properties to paper and other cellulosic materials. These moieties as defined by R are derived from fatty acid including lauric acid, myristic acid, palmitic acid, oleic acid, arachidic acid, behenic acid, linoleic acid, and linolenic acid and mixtures thereof.

In accordance with the invention of the present invention, it has been found that compounds of formula (I), above, may be utilized as effective sizing or waterproofing agents for cellulosic materials. In practicing the process of this invention, cellulosic material is contacted with a dispersion comprising an effective sizing or waterproofing amount of one or more of these compounds of formula (I).

The term "cellulosic materials" include any material containing cellulose or regenerated cellulose. This may either be cotton, linen, rayon or other cellulosic textiles or mixtures thereof. Also included are all forms of paper, paperboard and paper pulp. The term "dispersion" as used in the present specification and claims include aqueous emulsions and solutions in compatible or non-reactive organic liquids. Furthermore, the term "effective sizing or waterproofing amount" as used in the present specification and claims is intended to include any amount that will provide effective sizing or waterproofing properties to a cellulosic material when employed in sufficient concentrations in a dispersion. Of course, this amount may vary because of many process parameters including the particular cellulosic material being treated; the specific compound or compounds of the present invention being utilized; the mode of application of the compound of this invention to the cellulosic material; degree of effectiveness required; and type of dispersion employed. Generally speaking, the total amount of one or more compounds of formula (I) being reacted with cellulosic material is believed to be from about 0.05% to about 5% by weight of dry fiber in the cellulosic material.

The step of "contacting" may be accomplished by applying the dispersion comprising one or more of active sizing or waterproofing agents of formula (I) to the cellulosic material in order to have these agents react with the cellulosic hydroxyl groups and thereby placing the hydrophobic groups on the cellulosic material. This contacting should be carried out at a high enough temperature and for a sufficient amount of time to effect this reaction with the cellulosic material. The dispersions of the present invention may be formulated and applied by any known methods. Moreover, the activity of the present class of compounds may be broadened by the addition therewith of other compatible known sizing or waterproofing agents.

As stated above, the sizing or waterproofing agents of formula (I) may be formulated with water into aqueous emulsions. Preferably, these aqueous emulsions may also contain retention aids, emulsifying agents and other additives conventionally used in papermaking or textile processing. The retention aids, while not chemically reacting with the cellulosic material themselves, are believed to act to bring the sizing or waterproofing agent into better contact with the cellulosic material. Thus, when a suitable retention aid is employed, the amount of sizing or waterproofing agent that is effective may be decreased and the cost of the sizing or waterproofing operation may be reduced. Suitable retention aids include cationic polyelectrolytes and polymers like cationic starches and their derivatives, polyacrylamides, polyamides, polyamide-polyamines, and polyethylene-imines. One preferred class of cationic starches include the "Cato" series of starches (e.g. Cato 210) available from National Starch Company. Preferred cationic starch derivatives include primary, secondary, tertiary and quaternary amine starch derivatives and other cationic nitrogen-substituted starch derivatives, as well as cationic sulfonium and phosphonium starch derivatives. Such derivatives may be preferred from all types of starches including those derived from corn, tapioca, potato, waxy maize, wheat and rice. Preferably, the weight ratio of the total amount of retention aid to the sizing or waterproofing agents of formula (I) is from about 2:1 to about 1:50, more preferable, from about 2:1 to about 1:20.

Such aqueous emulsions may also contain one or more emulsifying agents. Preferred emulsifying agents include cationic materials like cationic starches and nonionic materials like polyoxyethylene sorbitan fatty acid esters [e.g. polyoxyethylene (20) sorbitan monolaurate (Tween 20); polyoxyethylene (20) sorbitan monopalmitate (Tween 40); polyoxyethylene (20) sorbitan monostearate (Tween 60); polyoxyethylene (20) sorbitan monooleate (Tween 80); and polyoxyethylene (5) sorbitan monooleate (Tween 81)] and sorbitan fatty acid esters [e.g. sorbitan monolaurate (Span 20); sorbitan monopalmitate (Span 40); sorbitan monostearate (Span 60) and sorbitan monooleate (Span 80)]. Other possibly suitable emulsifying agents are disclosed in U.S. Pat. No. 4,222,820 which issued to Hiskens et al on Sept. 16, 1980. That patent is incorporated herein by reference in its entirety. Anionic emulsifiers such as sodium lignosulfonate may also be used. Suitable nonionic emulsifying agents include the above-noted "Tween" and "Span" series of emulsifiers, which are available from ICI Americas, Inc. of Wilmington, Delaware. Suitable anionic emulsifiers include "Orzan LS, which is available from ITT Raynor of Stamford, Connecticut. The preferred weight ratios of emulsifying agent to the fatty acid adduct of the 1,2,4-triazole is from about 1:1 to about 1:50, more preferably from about 1:2 to about 1:50.

The optimum concentrations of the sizing or waterproofing agent, retention aid and emulsifying agent should take into account the desired viscosity of the emulsion (to minimize storage and transportation costs yet have a flowable product). Generally, the aqueous emulsion contain from 0.01 to 10 percent by weight of sizing agent, from 0 to 5 percent by weight of emulsifying agent and from 0 to 10 percent by weight of retention aid, the weight ratios of size to emulsifying agent and retention aid being selected so as to satisfy the ratios hereinbefore described. The emulsion products of the present invention may be used with conventional emulsification equipment and systems and do not impose special operating requirements.

Compositions for treating the cellulosic material may be prepared by dissolving the fatty acid adduct in a non-reactive organic liquid. The term "non-reactive organic liquid" indicates that an organic liquid is chosen which is unreactive towards the fatty acid adduct and the cellulosic material. Such a liquid is free of hydroxyl and amino groups, so that methanol, for example, is unsuitable whereas hydrocarbons, halocarbons or halohydrocarbons, such as benzene, toluene, dichloromethane or carbon tetrachloride and aliphatic esters and ketones are suitable. Preferred liquids have a boiling point of less than about 150° C., and more preferred below 100° C., so that removal from the cellulosic material by evaporation is rendered easier and requires less energy.

Suitably the cellulosic material in the form of dried sheets or rolls may be treated by any conventional process used to impregnate fibrous materials. Thus, dried sheets or rolls of paper or other cellulosic material such as a textile cloth may be passed through a bath containing an aqueous emulsion of the fatty acid adduct or a solution of the fatty acid adduct in a compatible organic solvent, as hereinbefore described. The concentration of the fatty acid adduct in the emulsion or solution and the amount of emulsion or solution absorbed by the substrate govern the addition level of the fatty acid adduct to the cellulosic substrate. A high proportion of the fatty acid adduct added is believed to react with the cellulosic material. The amount of the composition absorbed by the sheets or rolls may be controlled by conventional methods such as the use of squeeze rollers. Other suitable methods of impregnation include brushing, spraying and roller-coating.

If the cellulosic material is paper and the compounds of formula (I) are to be used as external or surface paper sizing agents, one preferred method of contacting is to apply aqueous paper stock with an aqueous emulsion comprising the active compounds of formula (I). The aqueous paper stock may be produced by any conventional process, for example, mechanical pulp, semi-chemical pulp, or chemical pulp. The paper, or pulp from which it was made, may be bleached, semi-bleached or unbleached or combination thereof, and may contain fillers or pigments such as clays, (e.g. kaolin), calcium carbonate, titanium dioxide calcium sulfate, talc, diatomaceous earth, or zinc oxide. A more detailed description of external or surface sizing of paper may be found in James P. Casey, *Pulp and Paper Chemistry and Chemical Technology, Third Edition, Volume III,* Chapter 20 "Surface Sizing" pages 1687–1794. This chapter is incorporated herein by reference in its entirety.

If the cellulosic material is paper pulp and the compounds of formula (I) are to be used as internal paper sizing agents, then an aqueous emulsion containing the sizing agent may preferably contact the pulp under moderately acidic conditions through neutral to slightly alkaline conditions, i.e. a pH from about 4 to about 10. More preferably, a pH from about 7 to about 9 is desirable because conventional fillers like calcium carbonate may be employed and acidic processing conditions associated with inferior types of paper are avoided. A more detailed description of external or surface sizing of paper may be found in the above-noted Casey book, Chapter 16, "Internal Sizing" pages 1547–1592. This chapter is incorporated herein by reference in its entirety.

After contact between the fatty acid adduct and cellulosic material, the treated material is preferably dried. The temperature of the drying stage is selected so as not to damage the material, but is typically in excess of about 50° C. For example, paper is often dried from about 70° C. to about 120° C. and textiles from about 100° to about 150° C. Preferably, the dispersion is used in such an amount and of such concentrations that the waterproofed textile or sized paper, when dry, contains the minimum weight percentage of fatty acid adduct to give as effective waterproofing or sizing as is required.

It should be clearly understood that the formulations of these sizing or waterproofing dispersions; the ingredients which make up such formulations other than the active compounds of formula (I); the dosages of these other ingredients, and the means of applying these dispersions to the cellulosic material may include all known and conventional substances, amounts and means, respectively, that are suitable for obtaining the desired sizing or waterproofing effect. And, therefore, such process parameters are not critical to the present invention.

The following Examples further illustrate the present invention. All parts and percentages are by weight unless otherwise stated.

EXAMPLE 1

Preparation of 1-Stearoyl-1,2,4-triazole

A 3-neck flask was charged with excess 1-hydrogen-1,2,4-triazole [45 g ( 0.65 moles)], stearoyl chloride [100 g (0.35 moles)] and dichloroethane (200 g) as a solvent. The mixture was heated to reflux temperature under nitrogen while stirring for three hours. Then the precipitated 1,2,4-triazole hydrochloride salt was immediately filtered from the hot reaction mixture. The 1-stearoyl-1,2-4-triazole was then allowed to crystallize out from the cooled filtrate. This product was collected and dried. The yield was quantitative. The product was analyzed by $C^{13}$ NMR and found to contain the desired 1-stearoyl-1,2,4-triazole.

EXAMPLE 2

Preparation of Aqueous Emulsion of 1-Stearoyl-1,2,4-triazole

An aqueous solution (3% by weight solids) of cationic starch (Cato 210, made by National Starch, Inc. of Bridgewater, N.J.) was heated to 72° C. A melt (3.2 g) of 1-stearoyl-1,2,4-triazole (made in Example 1) and a sodium lignosulfonate (Orzan LS, made by ITT Raynor of Stamford, CT) emulsifier (10% of the weight of the 1-stearoyl-1,2,4- triazole) was added to the starch solution while stirring. The mixture was then emulsified on a Ross Lab ME mixer at 10,000 rpm for 5 minutes. To this emulsion (132 g) was added water (258 g). This final emulsion was mixed by hand for 1 minute and then either added directly to the disintegrated pulp slurry (see Example 4) or diluted and poured on to unsized filter paper (see Example 3).

EXAMPLE 3

Externally Sized Paper Prepared Using 1-Stearoyl-1,2,4-triazole

The aqueous emulsion from Example 2 (6 g) was diluted with water (74 g). A portion of this emulsion (20 ml) was poured onto unsized filter paper (Whatman 4 Qualitative, 18.5 cm diameter). After a contact time of 1 minute, the excess liquid was poured off and the paper was dried in an oven at 120° C. for 10 minutes. In comparison to Cobb value of 175 for unsized filter paper, the stearoyl triazole sized sample exhibited a Cobb value of 25 to 35 as determined by TAPPI Standard 41. A Cobb value of 25 or less is indicative of a high degree of sizing. A Cobb value of greater than 35 is indicative of a low degree of sizing.

EXAMPLE 4

Internally Sized Paper Prepared Using 1-Stearoyl-1,2,4-triazole

The procedure followed for the preparation of handsheets is a TAPPI Standard method T205 m-58. Bleached hardwood Kraft (19.2 g) and bleached softwood pulp (4.8 g) was added to distilled water (2000 ml) and disintegrated for 75,000 revolutions using a Standard Disintegrator (TMI 73-4, Testing Machines, Inc. of Amityville, N.Y.). To one half of this slurry was added water (7 liters) and the size emulsion from Example 2 (6 g). A portion of this slurry (1000 ml) was poured into a standard sheet machine (TMI 73-1, Testing Machines, Inc.) and, after draining off the water, the wet paper sample was pressed onto a piece of blotting paper using a standard couch roll and couch plate. The paper sheet and blotting paper were placed on a drying disk and pressed using a standard press with pressure gauge (TMI 73-3, Testing Machines, Inc.). The first pressing was performed at 50 psi for 5 minutes. A second pressing was then preformed at 50 psi for 2 minutes. After pressing, the blotting paper was removed and the paper sheet and drying disk were fitted into a drying ring. The sample was dried in an oven at 120° C. for 5 minutes. The Cobb value was then measured to be 15.

EXAMPLE 5

Preparation of Aqueous Emulsion of 1-Stearoyl-1,2,4-triazole using Nonionic Surfactants An aqueous emulsion of cationic starch was prepared according to Example 3. A melt of stearoyl triazole (2.8 g) mixed with Tween 80 polyoxyethylene (20) sorbitan monooleate (0.09 g) and Span 80 sorbitan monooleate (0.21 g) (Tween 80 and Span 80 emulsifiers are supplied by ICI, Wilmington Delaware) was added to a 3% solution of the cationic starch (190 g) heated to 72° C. The mixture was poured into a Waring blender cup which was heated to 80° C. and blended at 23,000 rpm using a polytron, Rotor-Stator blade and a Waring 7012G motor. After blending for 90 seconds, the mixture (132 g) was diluted to 390 g with distilled water.

EXAMPLE 6–8

The procedure from Example 5 was repeated except that other Span and Tween emulsifiers were used in place of Span 80 and Tween 80. The results are shown in the following Table I.

TABLE I

| Example No. | Name | Emulsifier Wt. (g) | Name | Wt. (g) |
|---|---|---|---|---|
| 6 | Tween 80 | .11 | Tween 81 | .19 |
| 7 | Span 20 | .12 | Tween 20 | .18 |
| 8 | Span 40 | .12 | Tween 40 | .18 |

EXAMPLE 9–12

The procedure for externally sizing paper followed in Example 3 was repeated except that the pH of the water was adjusted to 8.5 by the addition of $NaHCO_3$ 0.82 g/73 g water). The Cobb values of the paper treated with the aqueous emulsions from Examples 5–8 are contained in the following Table II.

TABLE II

| Example No. | Emulsion From Example No. | Cobb Value |
|---|---|---|
| 9 | 5 | 22 |
| 10 | 6 | 33 |
| 11 | 7 | 20 |
| 12 | 8 | 18 |

EXAMPLE 13

Preparation of Internally Sized Paper at pH 8.5 and Containing $CaCO_3$

The procedure for the preparation of a pulp slurry according to Example 4 was repeated except that bleached hardwood Kraft (17.2 g) and bleached softwood pulp (4.3 g) were disintegrated for 75,000 revolutions in water (2000 ml). To one half of that resulting slurry was added $NaHCO_3$ (82 g, pH of 8.5), calcium carbonate (1.2 g) and 6 g of the size emulsion from Example 8. After preparing paper sheets, the Cobb value was measured to be 15.

EXAMPLE 14

Preparation of External Sized Paper with a Non-Aqueous Solution of 1-Stearoyl-1,2,4-Triazole Stearoyl triazole (0.6 g) was dissolved in tetrahydrofuran (THF) (100 g). A portion of this mixture (12 g) was diluted to 25 ml with THF and poured into unsized filter paper (Whatman 4 Qualitative, 18.5 cm diameter) contained in an evaporating dish. The entire content of the dish was placed in an oven heated to 120° C. for 30 minutes. As compared to the rapid penetration of water into untreated filter paper the paper treated with the THF solution of stearoyl triazole failed to adsorb any water.

What is claimed is:

1. A process for treating a cellulosic material selected from the group consisting of cellulose, regenerated cellulose, and mixtures thereof, comprising the steps of: contacting the cellulosic material with a dispersion comprising an effective sizing or waterproofing amount of a fatty acid adduct of a 1,2,4-triazole having the formula:

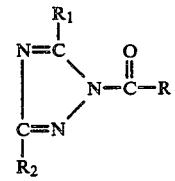

wherein R is an alkyl or alkenyl group having about 11 to about 21 carbon atoms and wherein $R_1$ and $R_2$ are individually selected from hydrogen or a lower alkyl group having 1 to 4 carbon atoms.

2. The process of claim 1 wherein said dispersion is a solution in an organic solvent.

3. The process of claim 1 wherein said dispersion is an aqueous emulsion.

4. The process of claim 1 wherein said cellulosic material is paper.

5. The process of claim 1 wherein said cellulosic material is a textile material.

6. The process of claim 1 wherein said cellulosic material is paper pulp.

7. The process of claim 1 wherein said R is $-(CH_2)_{16}CH_3$ and $R_1$ and $R_2$ are both hydrogen.

8. The process of claim 1 wherein said dispersion further comprises a retention aid in a weight ratio of said retention aid to said fatty acid adduct of 1,2,4-triazole of from 1:1 to 1:50.

9. The process of claim 8 wherein said retention aid is a cationic starch.

10. The process of claim 1 wherein said dispersion further comprises an emulsifying agent in a weight ratio of said emulsifying agent to said fatty acid adduct of a 1,2,4-triazole of from 1:1 to 1:50.

11. A process for treating an aqueous paper stock having a pH from about 4 to about 10, comprising the step of:

contacting said paper stock with an aqueous emulsion comprising at least one retention aid, at least one emulsifying agent and an effective sizing or waterproofing amount of fatty acid adduct of a 1,2,4-triazole having the formula:

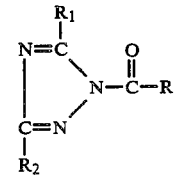

wherein R is an alkyl or alkenyl group having from about 11 to about 21 carbon atoms, wherein $R_1$ and $R_2$ are individually selected from hydrogen or a lower alkyl group having 1 to 4 carbon atoms and wherein the weight ratio of said retention aid to said fatty acid adduct of a 1,2,4-triazole is from about 2:1 to about 1:50 and wherein the weight ratio of said emulsifying agent to said fatty acid adduct is from about 1:1 to 1:50.

12. The process of claim 1 wherein said R is $-(CH_2)_{16}CH_3$ and $R_1$ and $R_2$ are both hydrogen.

13. A cellulosic material treated with an effective sizing or waterproofing amount of a fatty acid adduct of a 1,2,4-triazole having the formula:

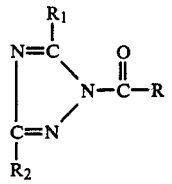

wherein R is an alkyl or alkenyl group having from about 11 to about 21 carbon atoms and wherein $R_1$ and $R_2$ are individually selected from hydrogen or a lower alkyl group having 1 to 4 carbon atoms.

14. The treated cellulosic material of claim 13 wherein said cellulosic material is a paper stock.

15. The treated cellulosic material of claim 13 wherein said R is $-(CH_2)_{16}CH_3$ and $R_1$ and $R_2$ are both hydrogen.

* * * * *